US010507513B2

(12) United States Patent
Yang et al.

(10) Patent No.: US 10,507,513 B2
(45) Date of Patent: Dec. 17, 2019

(54) SERVO-ROTATING ALL-FUNCTION TOOL MODULE FOR USE WITH SPRING FORMING MACHINE

(71) Applicant: Union Precision Hardware Co., Ltd., Huizhou (CN)

(72) Inventors: Yao Ming Yang, New Taipei (TW); Hua Yun Hsin, Keelung (TW); Neng Wen Mao, Nanzui Yuanjiang (CN)

(73) Assignee: UNION PRECISION HARDWARE CO., LTD., Huizhou (CN)

( * ) Notice: Subject to any disclaimer, the term of this patent is extended or adjusted under 35 U.S.C. 154(b) by 336 days.

(21) Appl. No.: 15/429,142

(22) Filed: Feb. 9, 2017

(65) Prior Publication Data

US 2018/0085819 A1 Mar. 29, 2018

(30) Foreign Application Priority Data

Sep. 29, 2016 (TW) ..... 105214772 U

(51) Int. Cl.
*B21F 35/00* (2006.01)
*B21F 1/00* (2006.01)
*B21F 3/02* (2006.01)

(52) U.S. Cl.
CPC ..... *B21F 35/00* (2013.01); *B21F 1/006* (2013.01); *B21F 3/02* (2013.01)

(58) Field of Classification Search
CPC ..... B21F 35/00; B21F 1/006; B21F 3/002; B21F 3/02
USPC ..... 72/447
See application file for complete search history.

(56) References Cited

U.S. PATENT DOCUMENTS

2011/0016942 A1* 1/2011 Etienne ..... B21F 3/02 72/199
2015/0075244 A1* 3/2015 Itaya ..... B21F 3/02 72/135
2017/0182545 A1* 6/2017 Yang ..... B21F 35/00
2018/0085818 A1* 3/2018 Yang ..... B21F 3/02
2018/0085819 A1* 3/2018 Yang ..... B21F 1/006

FOREIGN PATENT DOCUMENTS

TW M527355 U 8/2016
TW M531337 U 11/2016

* cited by examiner

*Primary Examiner* — David B Jones
(74) *Attorney, Agent, or Firm* — Chun-Ming Shih

(57) ABSTRACT

A servo-rotating all-function tool module is provided for use with a spring forming machine and includes an axle rotating tool module that is mounted, together with an axle, to a front wall board and includes a tool and an axle slide base mounted to the axle, so that the axle slide base is acted upon by a force to slide along the axle, the tool is caused to press downward or return upward. A servo transmission module assembly is mounted to the spring forming machine to provide a driving force for causing the axle slide base to slide along the axle. Since the tool module is mounted, together with the axle, to a front wall board of the spring forming machine, the direction in which the tool approaches a wire can be varied by rotating the axle in order to conduct operations of bending at different angles and twisting/looping.

14 Claims, 12 Drawing Sheets

SERVO-ROTATING ALL-FUNCTION TOOL MODULE FOR USE WITH SPRING FORMING MACHINE

(a) TECHNICAL FIELD OF THE INVENTION

The present invention relates generally to the field of spring forming machines, and more particularly to an all-function tool module that is drivable through rotation of a servo for being used with a spring forming machine.

(b) DESCRIPTION OF THE PRIOR ART

A spring forming machine is a piece of machinery for making various types or models of springs. The manufacturing process is generally such that a feeding roller that is capable of clamping and holding a wire for making a spring, which will be referred to as a spring-making wire for simplicity, is used to feed the spring-making wire through a through hole formed in a front wall board of the machine to allow various tools that are mounted to the front wall board to approach and engage, in a sideway direction, the spring-making wire to conduct various operations, such as bending, twisting or looping, and cutting, in order to complete the manufacture of a spring. In addition, various programs are loaded in advance in a processor combined with the spring forming machine so that execution of these programs controls the wire feeding means and the tools mounted to the front wall board of the spring forming machine to conduct various operations, such as bending, twisting or looping, and cutting, which are necessary for different phases of the manufacturing operation to thereby achieve the purposes of making springs of various types and models.

The above-discussed existing spring forming machine is fully capable of achieving the purpose of making various sorts of springs. However, the number of the tools that are mounted to the front wall board is limited and the tools are allowed to do linear movements on the front wall board so that the movements of the tools approaching the spring-making wire are generally of the same angle and direction, making it not possible to suit the needs for bending and twisting or looping in all directions during the manufacturing of springs manufacturing. To cope with such a problem, spring forming machines that are capable of rotating the wires are available. Such a kind of spring forming machines, however, is expensive and may be incapable of performing desired operations due to the gauges of the sprig-making wires being small, so that such machines do not suit the need for contemporary need for making diverse forms of springs.

SUMMARY OF THE INVENTION

In view of the above problems, an objective of the present invention is to provide a servo-rotating all-function tool module for use with a spring forming machine, which comprises a tool mounted, together with an axle, to a front wall board of the spring forming machine, in a rotatable manner, such that rotation of the axle changes the direction that the tool takes to approach a wire thereby achieving a function that is generally achievable with a high-end spring forming machine featuring all-direction bending.

Another objective of the present invention is to provide a servo-rotating all-function tool module, which greatly improve stability of a downward pressing operation and a returning operation of a tool.

To achieve the above and other objects, the present invention provides a servo-rotating all-function tool module, which is mountable to a spring forming machine to serve as an all-direction forming tool of the spring forming machine. The spring forming machine comprises a front wall board, an axle retention seat rotatably mounted to the front wall board, and an axle mounted to the axle retention seat. The axle retention seat is extended frontward to form two support arms. A push plate is disposed between the two support arms. The tool module comprises a servo transmission module assembly and an axle rotating tool module that comprises an axle slide base, an oscillating bar, an elastic element, such as a spring, a cam plate, a bearing, and a tool.

In the tool module, the axle slide base comprises an opening and a slide base hole corresponding to the axle so as to be fit over the axle with the slide base hole for sliding along the axle. Two parallel support braces are arranged above the opening. The oscillating bar comprises a first end and a second end. A shaft hole is formed between the first end and the second end so as to mount, in a rotatable manner, the oscillating bar between the two support arms of the axle retention seat. The first end of the oscillating bar is located under the push plate and the second end extends frontward through the opening of the axle slide base.

An elastic element is mounted between the first end of the oscillating bar and the push plate to provide a downward push force to the oscillating bar. A cam plate is mounted to the second end of the oscillating bar and comprises an ascending slope. A bearing is positioned against the ascending slope that is rotatably mounted between the two support braces of the axle slide base. Thus, when the servo transmission module assembly that is mounted to the sprig forming machine drives the axle slide base to slide along the axle, the axle slide base causes the bearing to roll along the ascending slope to control, in combination with the elastic element, downward pressing or upward returning of the tool.

In an embodiment, the servo-rotating all-function tool module of the spring forming machine comprises a shaft pin that is fixed between the two support arms and is received through the shaft hole of the oscillating bar to rotatably fix the oscillating bar between the two support arms of the axle retention seat.

In an embodiment, the servo-rotating all-function tool module of the spring forming machine comprises a shaft pin that is fixed between the two support braces and is received through the bearing to rotatably fix the bearing between the two support braces of the axle slide base.

In an embodiment, the servo-rotating all-function tool module of the spring forming machine is structured such that the axle retention seat further comprises three parallel slide axles extending frontward therefrom. The three slide axles have ends to which a circular retention seat is fixed. The axle slide base is provided with three bearing holes respectively receiving the three slide axles to extend therethrough. Linear bearings are arranged between the three slide axles and the three bearing holes to make a sliding operation of the axle slide base stable.

In an embodiment, the servo-rotating all-function tool module of the spring forming machine is structured such that the servo transmission module assembly comprises: a support bracket, which is mounted to the front wall board at a location below the axle and comprises a slide rail; a servo-motor, which is mounted to the support bracket and comprises a rotary shaft; a rotary disc, which is mounted to the rotary shaft and is driven by the rotary shaft to rotate; a link bar seat, which comprises a central axle, a link bar, a slide block, which is positioned on the slide rail and two CF-series bearings, which are mounted to the slide block. The rotary disc comprising an eccentric shaft hole formed therein and the link bar seat is mounted on the eccentric shaft hole. An end of the link bar is rotatably mounted to the central axle of the link bar seat and an opposite end of the link bar is rotatably mounted to the slide block. Thus, the two CF-series bearings, which are mounted to the slide block, may clamp the axle slide base therebetween so as to drive the axle slide base to slide along the axle when the servomotor rotates.

In an embodiment, the servo-rotating all-function tool module of the spring forming machine is structured such that the rotary shaft of the servomotor and the support bracket comprise a bearing arranged therebetween to support the rotary shaft and eliminate oscillation caused by the rotation of the servomotor.

In an embodiment, the servo-rotating all-function tool module of the spring forming machine is structured such that the central axle of link bar seat and the link bar comprise a bearing arranged therebetween to facilitate driving of the link bar.

In an embodiment, the servo-rotating all-function tool module of the spring forming machine is structured such that the axle slide base is provided with a groove circumferentially formed therein and the slide block is provided, on two opposite sides thereof, with two annular frame members extending into the groove to balance a transmission force that the servo transmission module assembly applies to the axle slide base.

In an embodiment, the servo-rotating all-function tool module of the spring forming machine is structured such that the servo transmission module assembly comprises: a support bracket, which is mounted to the front wall board at a location below the axle; a servomotor, which is mounted to the support bracket and comprises a rotary shaft; a rotary disc, which is mounted to the rotary shaft and is driven by the rotary shaft to rotate; a first CF-series bearing, a coupling seat, which comprises a guide block and a guide slot, a slide seat, which comprises a slide rail and a guide groove in communication with the slide rail; a slide block; and two second CF-series bearings.

The rotary disc comprising an eccentric shaft hole formed therein to receive and fix the first CF-series bearing in the eccentric shaft hole to be partly accommodate in the guide slot of the coupling seat so that the guide block arranged in the guide groove of the slide seat drives the slide block mounted to the guide block of the coupling seat to slide along the slide rail of the slide seat mounted to the support bracket for driving the two second CF-series bearing that are mounted to the slide block to clamp the axle slide base so as to drive the axle slide base to slide along the axle when the servomotor rotates.

In an embodiment, the servo-rotating all-function tool module of the spring forming machine is structured such that the axle slide base is provided with a groove circumferentially formed therein and the slide block is provided, on two opposite sides thereof, with two annular frame members extending into the groove to balance a transmission force that the servo transmission module assembly applies to the axle slide base.

In an embodiment, the servo-rotating all-function tool module of the spring forming machine is structured such that the servo transmission module assembly comprises: a support bracket, which is mounted to a rear side of the front wall board; a servomotor, which is mounted to the support bracket and comprises a rotary shaft; a rotary disc, which is mounted to the rotary shaft and is driven by the rotary shaft to rotate; a cam seat, which comprises a guide rail; a bearing seat, which comprises a central axle extending into the guide rail, a bearing; two linear bearings, which are mounted to the front wall board; two slide axles, which extend through the two linear bearing respectively and have an end mounted to the cam seat at two ends of the guide rail; a push bar, which is mounted to an opposite end of the two slide axles; a push bar seat, which is mounted to the push bar; and two CF-series bearings.

The rotary disc comprising an eccentric shaft hole formed therein to receive and fix the bearing seat in the eccentric shaft hole so that the bearing that is arranged between the guide rail and the central axle may drive the cam seat, the two slide axles, the push bar, and the push bar seat to slide to drive the two CF-series bearings, which are mounted to the push bar seat to clamp the axle slide base therebetween so as to drive the axle slide base to slide along the axle when the servomotor rotates.

In an embodiment, the servo-rotating all-function tool module of the spring forming machine is structured such that the rotary shaft of the servomotor and the support bracket comprises a bearing arranged therebetween to support the rotary shaft and eliminate oscillation caused by the rotation of the servomotor.

In an embodiment, the servo-rotating all-function tool module of the spring forming machine is structured such that the axle slide base is provided with a groove circumferentially formed therein and the push bar seat is provided, on two opposite sides, with two annular frame members extending into the groove.

In summary, the present invention provides a servo-rotating all-function tool module for use with a spring forming machine and is applicable to all sorts of spring forming machines, wherein the direction in which a tool approaches a wire can be varied by rotating an axle in order to conduct operations such as bending at different angles and twisting/looping to achieve a function that is generally achievable with a high-end spring forming machine featuring all-direction bending. Further, due to an additional arrangement, as well as structural design, of slide axles, linear bearings, and annular frame members in the axle rotating tool module, the sliding of the axle slide base is made more stable to thereby greatly improve stability of downward pressing and returning of the tool.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
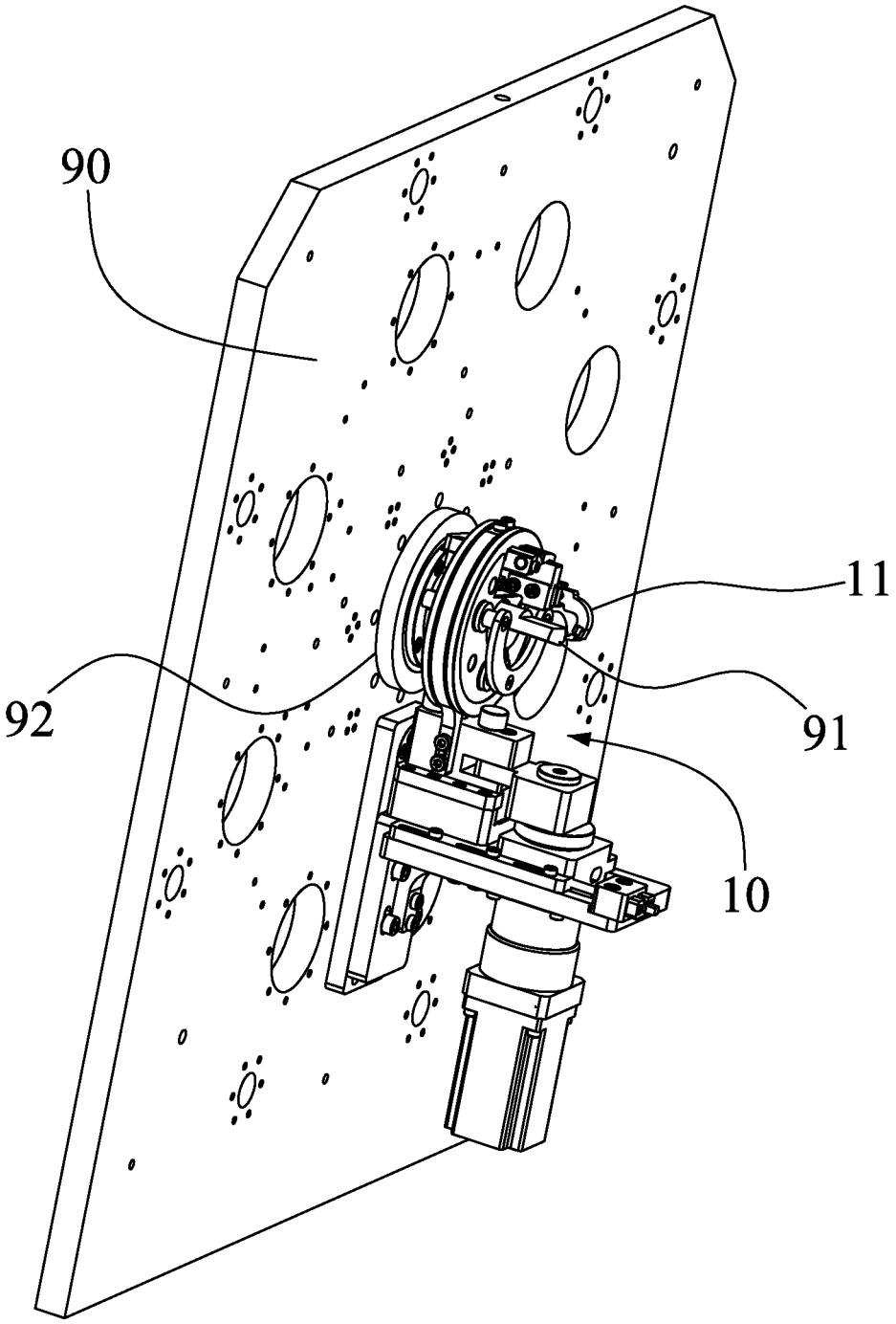
FIG. 1 is a perspective view showing a servo-rotating all-function tool module according to a first embodiment of the present invention mounted in a spring forming machine.
Figure 2:
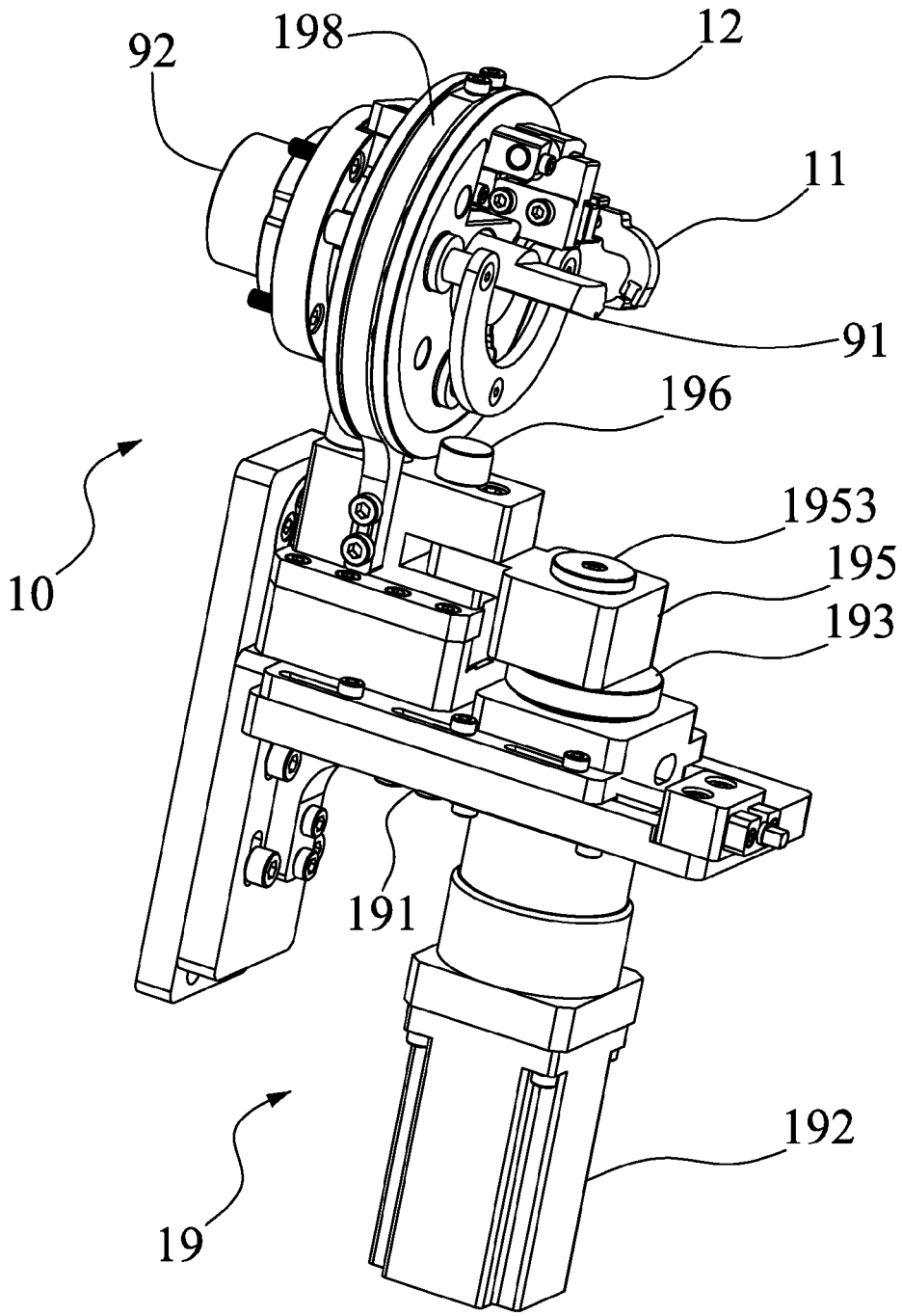
FIG. 2 is a perspective view illustrating a tool module and an axle retention seat and an axle of a front wall board of FIG. 1 in an assembled form.
Figure 3:
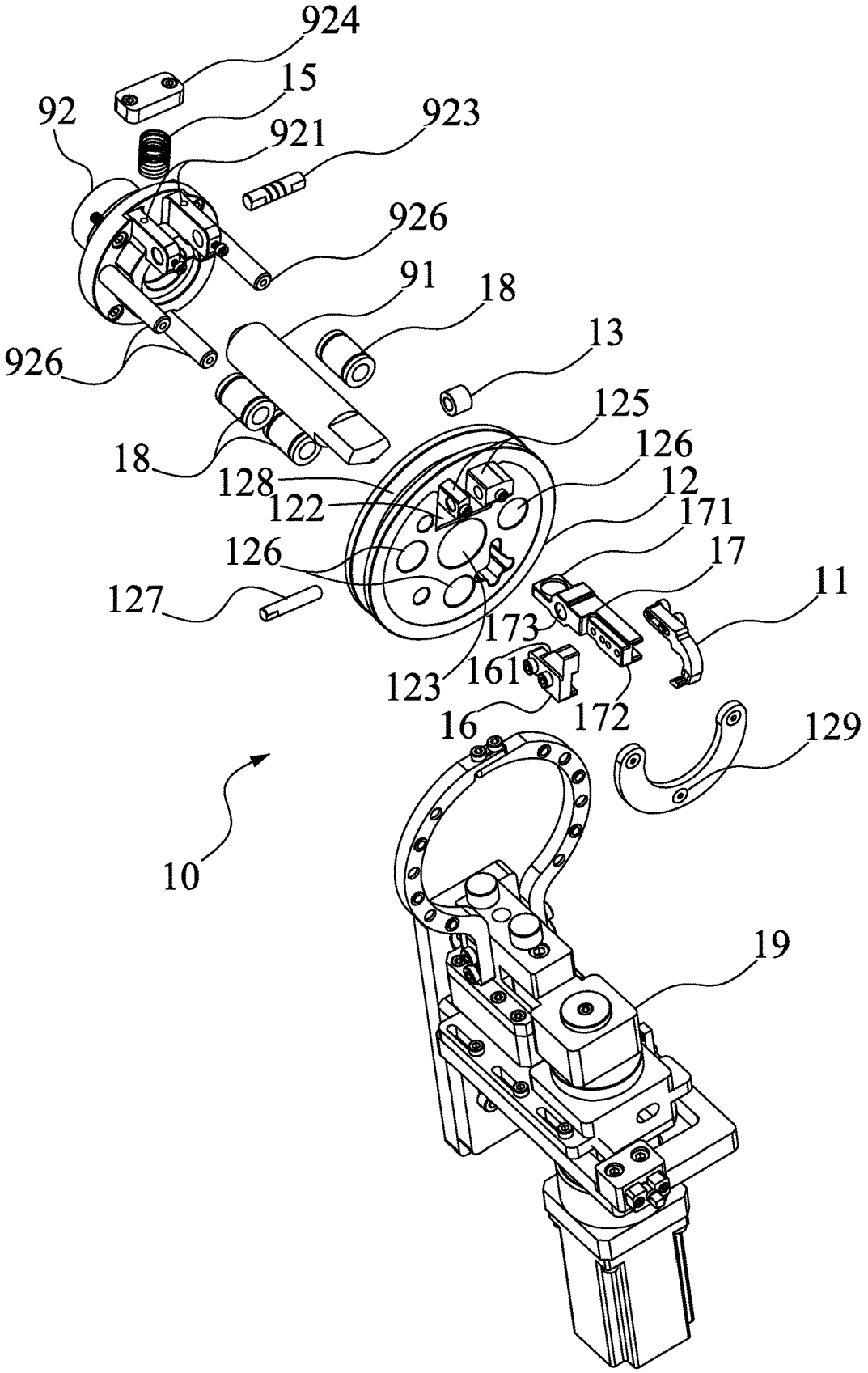
FIG. 3 is a partly exploded view of FIG. 2.

Referring to FIGS. 1-3, which are respectively a schematic view showing a servo-rotating all-function tool module according to a first embodiment of the present invention mounted in a spring forming machine and an assembled view and an exploded view showing a tool module, a front wall board axle retention seat, and an axle of FIG. 1, as shown in the drawings, the spring forming machine comprises an axle retention seat 92 rotatably mounted to the front wall board 90 and an axle 91 mounted to the axle retention seat 92. The axle retention seat 92 is extended frontward to form two support arms 921 that are parallel to each other and three slide axles 926 that are parallel to each other. A push plate 924 is fixed between the two support arms 921. The tool module 10 comprises a tool 11 that is mounted, together with the axle 91, to the front wall board 90 of the spring forming machine in a rotatable manner such that through rotation of the axle 91 mounted to the front wall board 90 of the spring forming machine, a direction in which a tool 11, such as a bending tool, of the tool module 10 is moved to approach a wire can be varied so as to achieve a function of all-direction bending of the wire without the need to rotate the wire whereby the tool is not subject to the same constraints of other tools (not shown) directly mounted to the front wall board 90 of the spring forming machine that are allow to conduct or perform a bending operation or other functions with a fixed angle due to installation angles thereof.

In the drawings, the tool module 10 comprises a servo transmission module assembly 19 and an axle rotating tool module that comprises an oscillating bar 17, an elastic element 15, which can be for example a spring, a cam plate 16, a bearing 13, the tool 11, linear bearings 18, a circular retention seat 129, and an axle slide base 12. The axle slide base 12 comprises an opening 122, three bearing holes 126 corresponding to the three slide axles 926 to receive the three slide axles 926 to extend therethrough, and a slide base hole 123 corresponding to the axle 91 so that the axle slide base 12, through being fit to the axle 91 with the slide base hole 123, together with the linear bearings 18 respectively arranged between the three slide axles 926 and the three bearing holes 126, is mounted to be slidable stably along the axle 91. The axle slide base 12 is provided with two parallel support braces 125 located above the opening 122. The circular retention seat 129 is fixed to ends of the three slide axles 926.

The oscillating bar 17 comprises a first end 171 and a second end 172 on which a tool seat is formed. Formed between the first end 171 and the second end 172 is a shaft hole 173, such that a shaft pin 923 that is fixed between the two support arms 921 and is fit through the shaft hole 173 of the oscillating bar 17 to rotatably fix the oscillating bar 17 between the two support arms 921 of the axle retention seat 92. The first end 171 of the oscillating bar 17 is located under the push plate 924 and the second end 172 extends frontward through the opening 122 of the axle slide base 12.

Arranged between the first end 171 of the oscillating bar 17 and the push plate 924 is the elastic element 15, which can be for example a spring, to provide a downward push force to the oscillating bar 17, while the second end 172 receives the cam plate 16 and the tool 11 to be mounted thereto in an easily replaceable manner. The cam plate 16 comprises an ascending slope 161 and the bearing 13 that is rotatably mounted between the two support braces 125 of the axle slide base 12 is positioned against the slope 161. The bearing 13 is rotatably mounted by having a pin shaft 127 that is fixed between the two support braces 125 extending therethrough.

Thus, when the servo transmission module assembly 19 mounted to the spring forming machine drives the axle slide base 12 to slide frontward along the axle 91, the axle slide base 12 causes the bearing 13 to roll along the slope 161 of the cam plate 16 to control the tool 11 to perform a downward pressing operation. Or, alternatively, when the servo transmission module assembly 19 mounted to the spring forming machine drives the axle slide base 12 to slide rearwards along the axle 91, the downward push force that the elastic element 15 applies to the first end 171 of the oscillating bar 17 makes the tool 11 that is mounted to the second end 172 of the oscillating bar move upwards.

Figure 4:
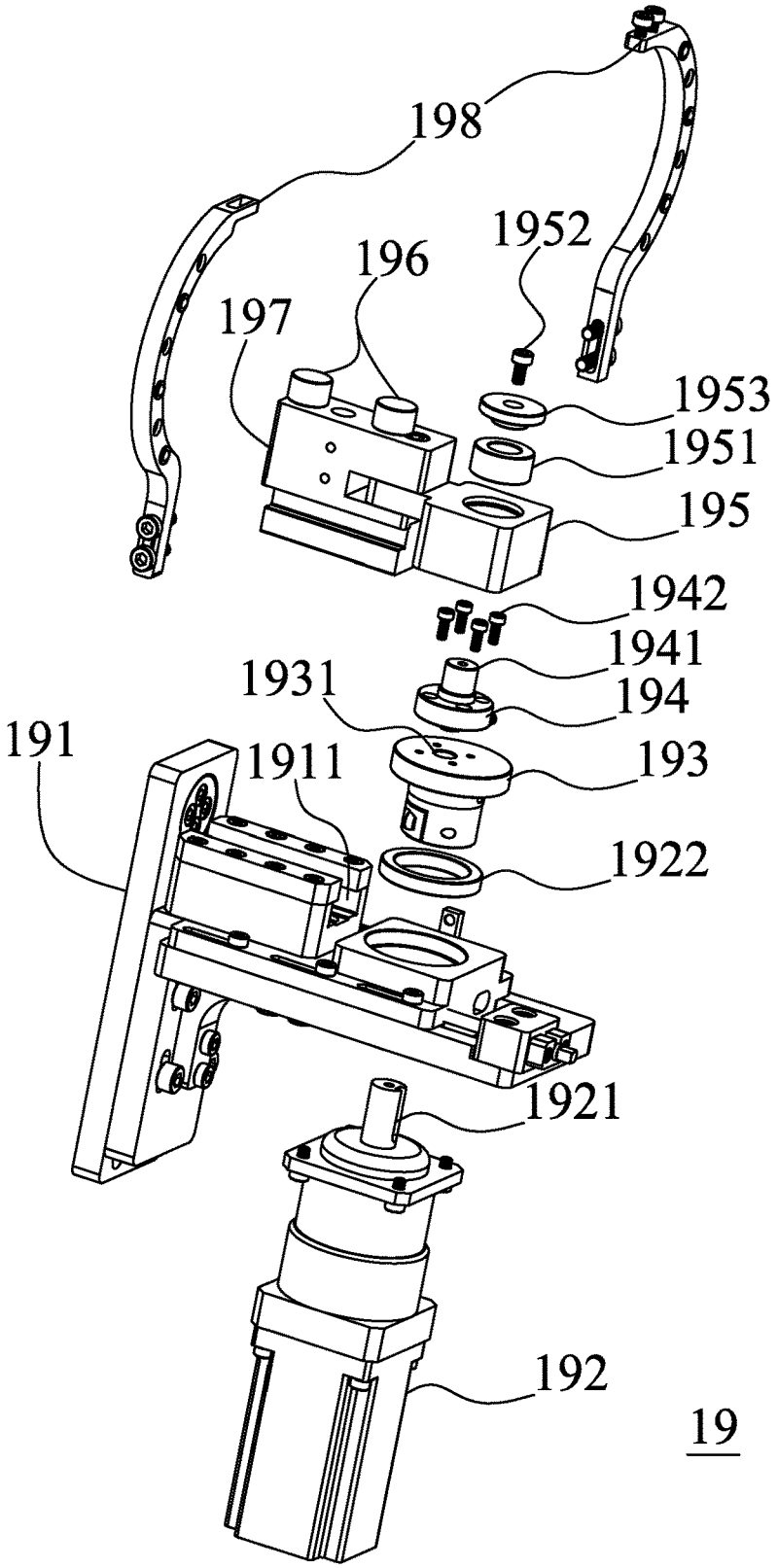
FIG. 4 is an exploded view of a servo transmission module assembly of FIG. 2.

In addition, as shown in FIG. 4, the servo transmission module assembly 19 comprises a support bracket 191 that is mounted to the front wall board 90 at a location below the axle 91 and comprises a slide rail 1911, a servomotor 192, which is mounted to the support bracket 191 and comprises a rotary shaft 1921 and of which an example may comprise a speed reducer, a rotary disc 193 that is mounted to the rotary shaft 1921 and is driven by the rotary shaft 1921 to rotate, a link bar seat 194 that comprises a central axle 1941, a link bar 195, a slide block 197 arranged on the slide rail 1911, two CF-series bearings 196, and two annular frame members 198.

The rotary disc 193 comprises an eccentric shaft hole 1931 formed therein. The link bar seat 194 is fixed by screws 1942 on the eccentric shaft hole 1931. An end of the link bar 195 is rotatably mounted to the central axle 1941 of the link bar seat 194 by means of a bearing 1951, a screw 1952, and a pad 1953, while an opposite end of the link bar 195 is rotatably mounted to the slide block 197 so that the axle slide base 12 is clamped between the CF-series bearings 196 that are mounted to the slide block 197 and also between the annular frame members 198 that are mounted to two opposite sides of the slide block 197 and received into a groove 128 that is formed in and circumferentially extends around the axle slide base 12 (see FIG. 2), whereby the axle slide base 12 can be driven to slide along the axle 91 in a more stable manner when the servomotor 192 rotates.

To eliminate potential swaying caused by the rotation of the servomotor 192, a bearing 1922 is arranged between the rotary shaft 1921 of the servomotor 192 and the support bracket 191. To reduce assembly tolerance between the annular frame members 198 and the groove 128 of the axle slide base 12, and also for reducing vibration induced by moving parts, the annular frame members 198 are preferably provided with multiple spring-included positioning beads for facilitating design and operation.

Figure 5:
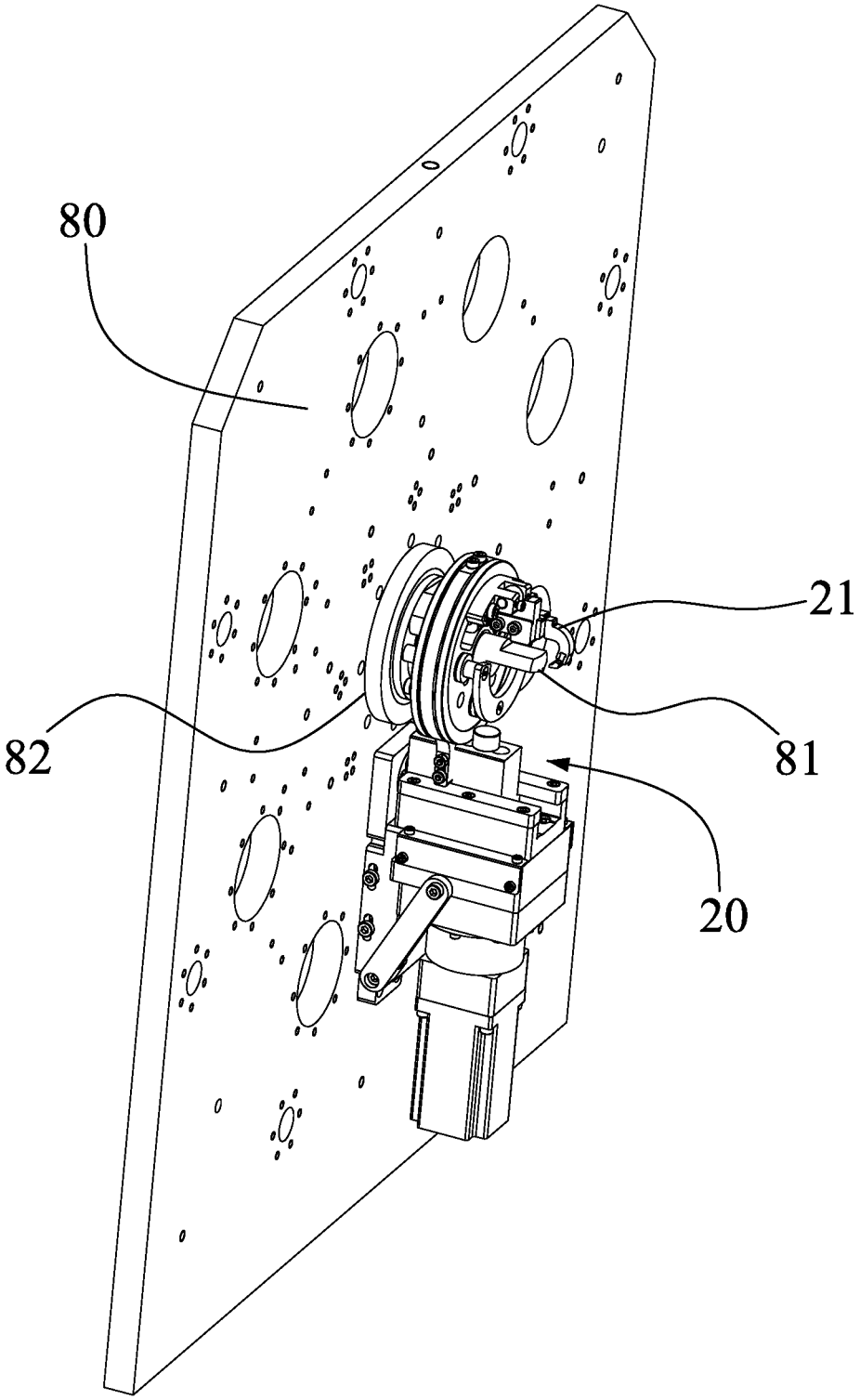
FIG. 5 is a perspective view showing a servo-rotating all-function tool module according to a second embodiment of the present invention mounted in a spring forming machine.
Figure 6:
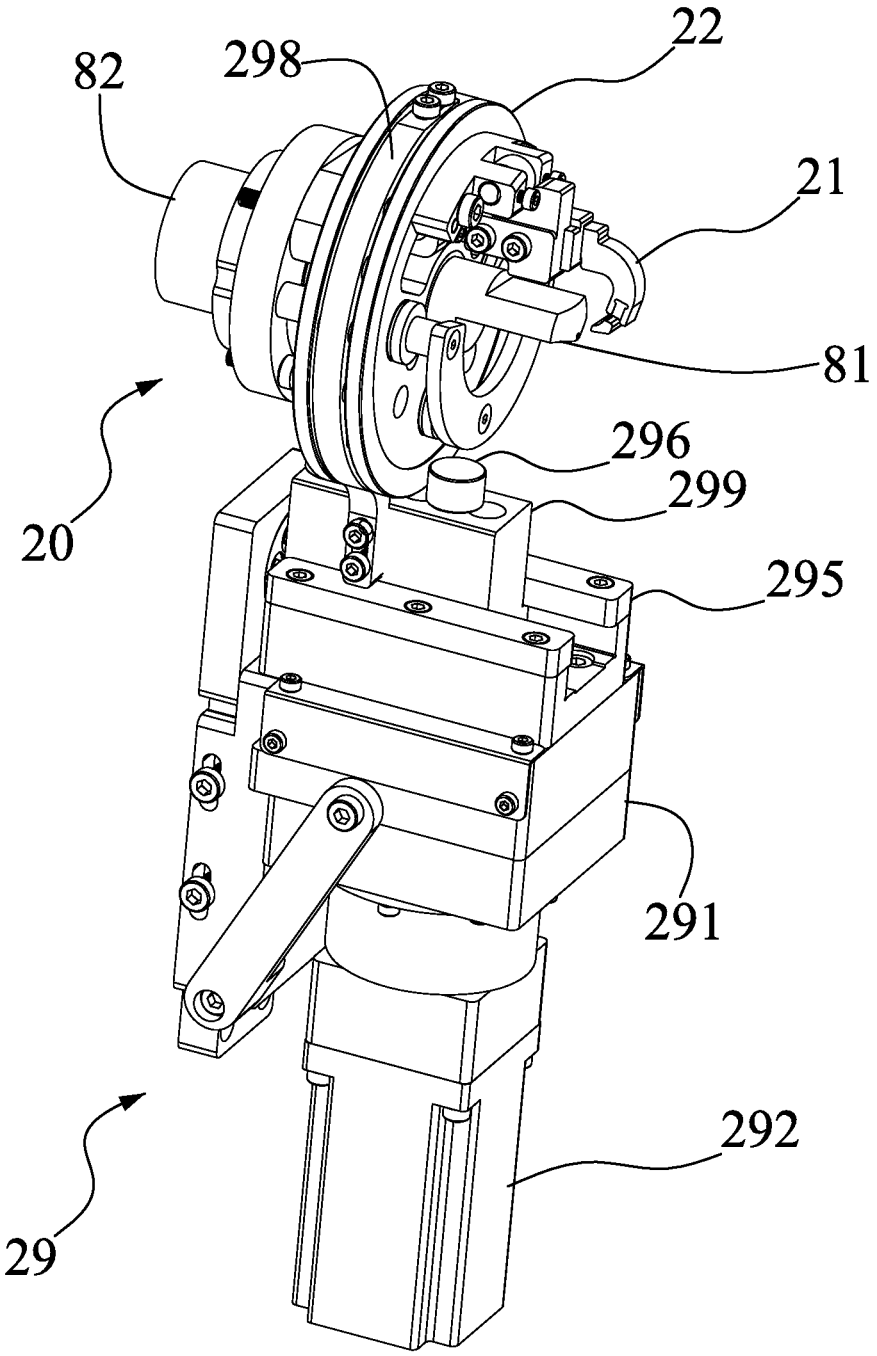
FIG. 6 is a perspective view illustrating a tool module and an axle retention seat and an axle of a front wall board of FIG. 5 in an assembled form.
Figure 7:
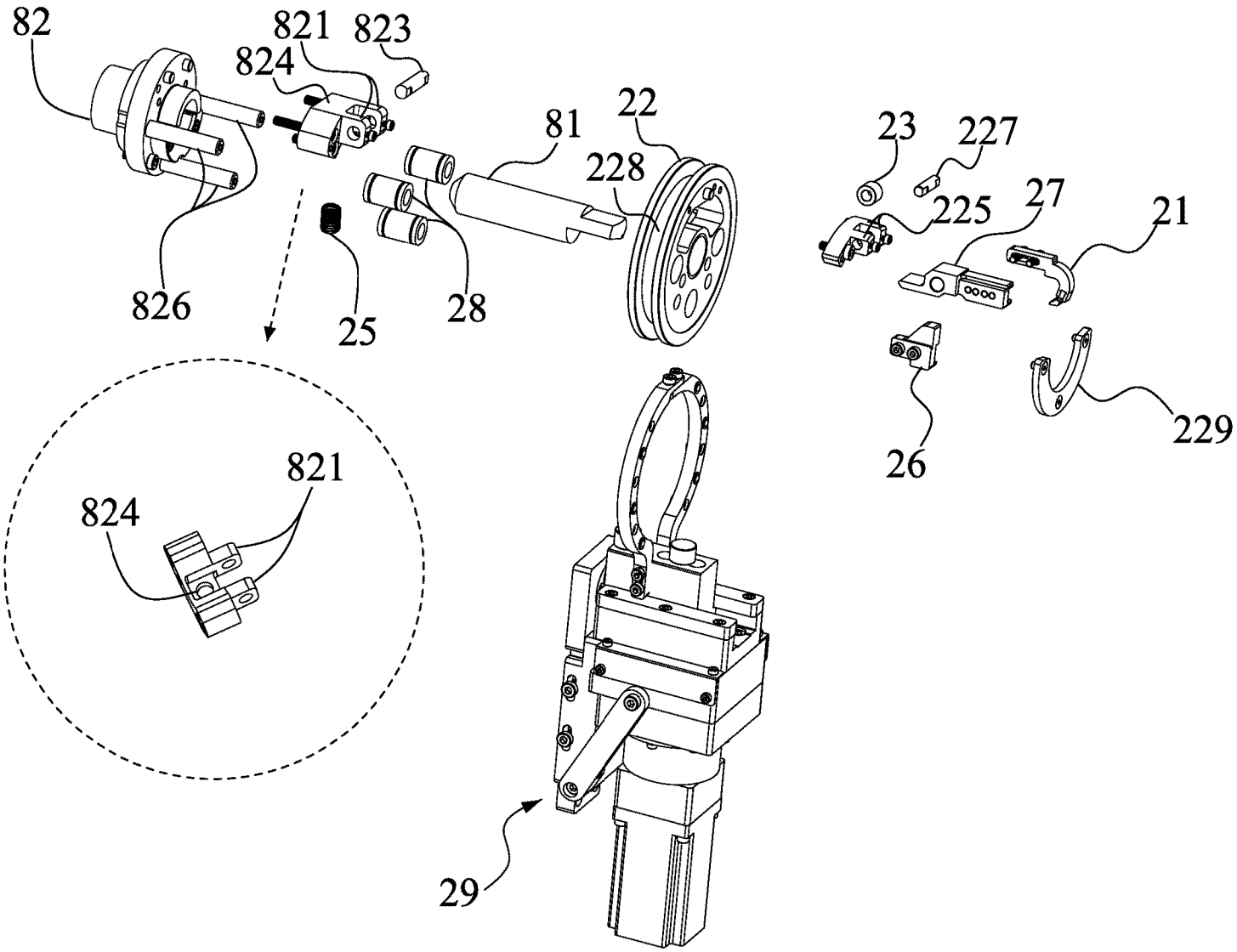
FIG. 7 is a partly exploded view of FIG. 6.

Referring to FIGS. 5-9, which are respectively a perspective view showing a servo-rotating all-function tool module according to a second embodiment of the present invention mounted in a spring forming machine and an assembled view and an exploded view showing a tool module, a front wall board axle retention seat, and an axle of FIG. 5, as shown in the drawings, the spring forming machine comprises an axle retention seat 82 rotatably mounted to the front wall board 80 and an axle 81 mounted to the axle retention seat 82. The axle retention seat 82 is extended frontward to form two support arms 821 that are parallel to each other and three slide axles 826 that are parallel to each other. A push plate 824 is formed between the two support arms 821 and receives a pin shaft 823 extending therethrough. The tool module 20 comprises an oscillating bar 27, an elastic element 25, which can be for example a spring, a cam plate 26, a bearing 23, a tool 21, linear bearings 28, a circular retention seat 29, a pin shaft 227, and axle slide base 22 comprising two support braces 225, which are respectively similar to the counterparts of the first embodiment, and a servo transmission module assembly 29 that is structurally different from the counterpart of the first embodiment.

A difference from the first embodiment is that the two support arms 821 extending frontward from the axle retention seat 82 and the two support braces 225 of the axle slide base 22 are each formed with a separate part securely mounted thereto. This arrangement provides a benefit that parts can be replaced to accommodate different lengths of the spring forming axle 81 so that a structural arrangement involving an axle retention seat 82 and an axle slide base 22 having support arms 821 or support braces 225 of different lengths is provided to help save cost of product design and manufacture.

Figure 8:
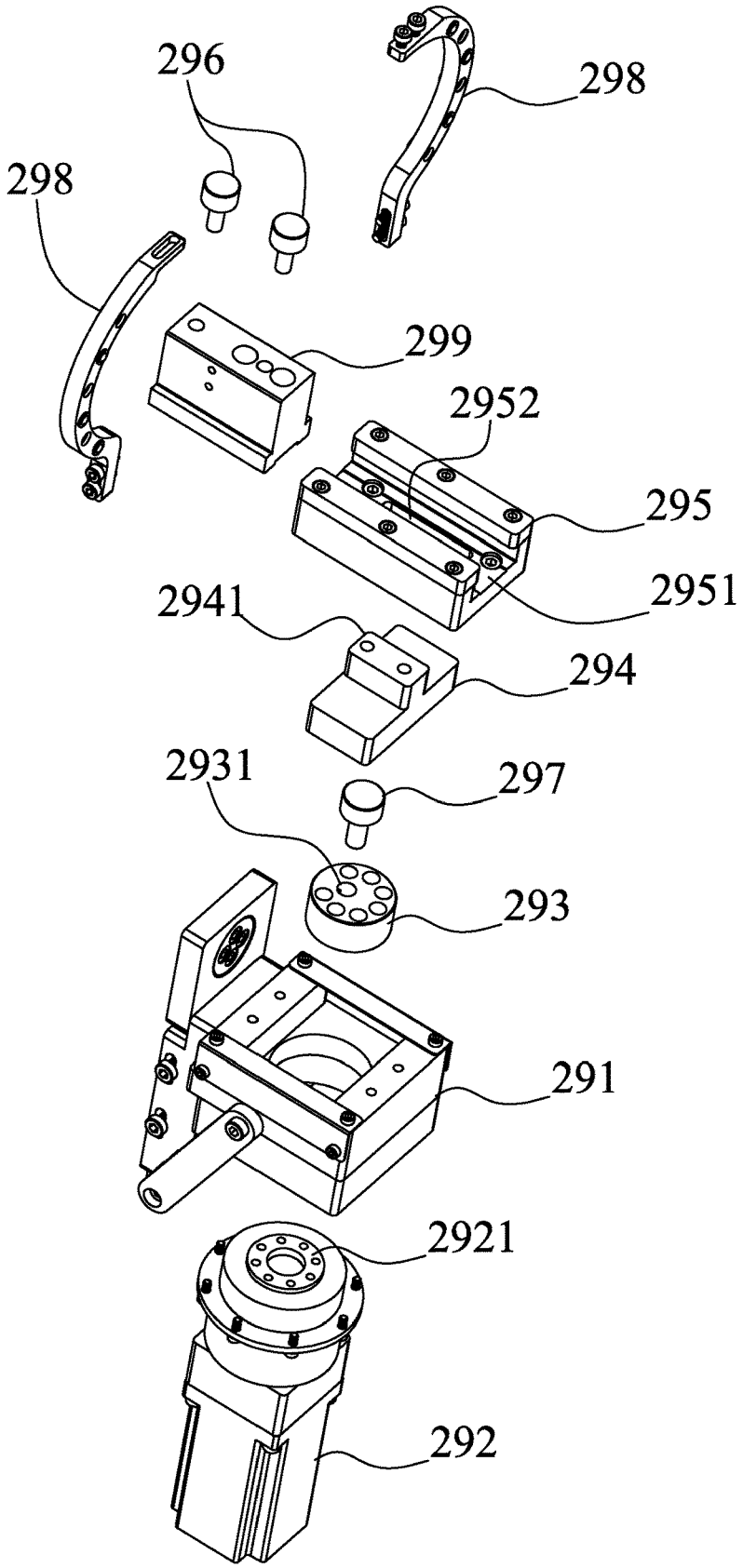
FIG. 8 is an exploded view of a servo transmission module assembly of FIG. 6.
Figure 9:
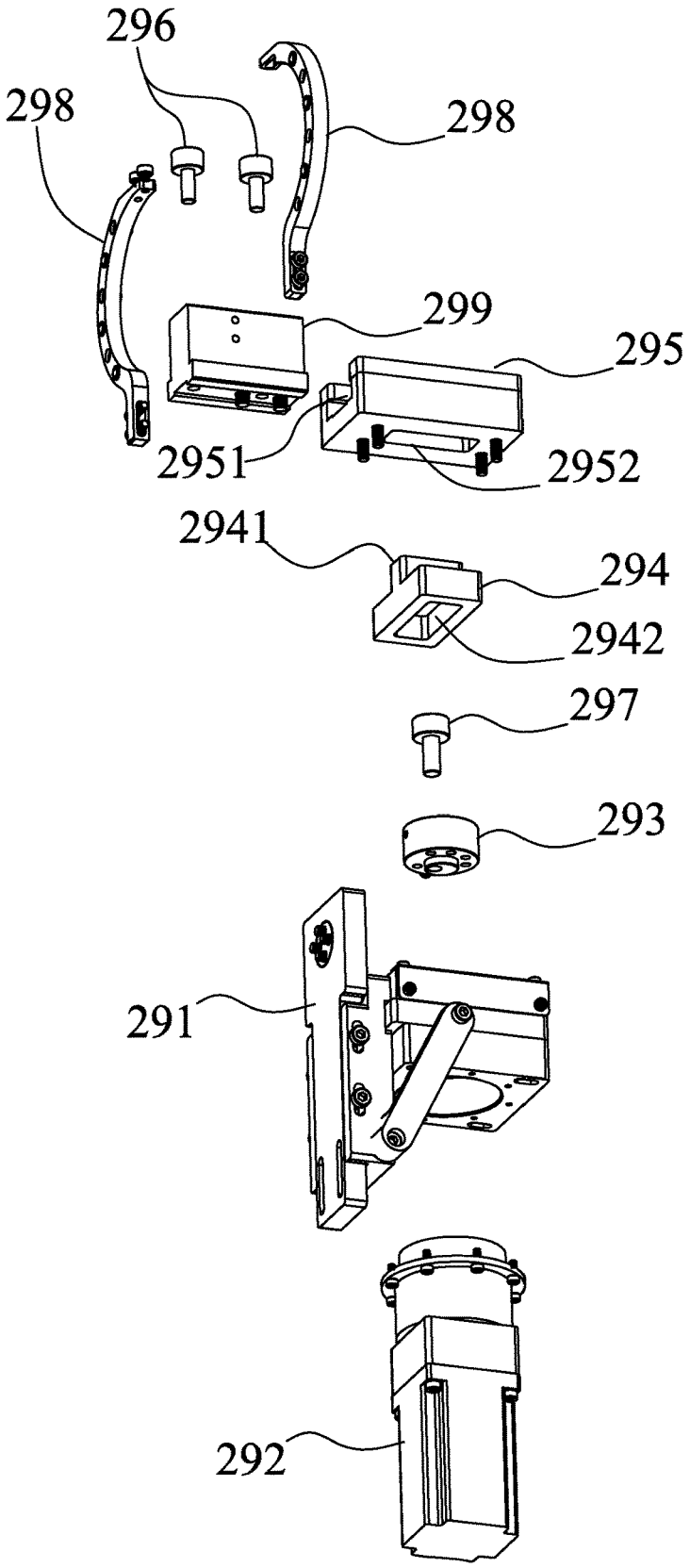
FIG. 9 is an exploded view taken from a different angle of FIG. 8.

As shown in FIGS. 8 and 9, the servo transmission module assembly 29 comprises a support bracket 291 that is mounted to the front wall board 80 at a location below the axle 81, a servomotor 292, which is mounted to the support bracket 291 and comprises a rotary shaft 2921 and of which an example may comprise a speed reducer, a rotary disc 293 that is mounted to the rotary shaft 2921 and is driven by the rotary shaft 2921 to rotate, CF-series bearings 296, 297, a coupling seat 294 that comprises a guide block 2941 and a guide slot 2942, a slide seat 295 comprising a slide rail 2951 and a guide groove 2952 in communication with the slide rail 2951, a slide block 299, and two annular frame members 298.

The rotary disc 293 comprises an eccentric shaft hole 2931 formed therein for receiving and fixing the CF-series bearing 297 in the eccentric shaft hole 2931 in a manner of being partly accommodated in the guide slot 2942 of the coupling seat 294 so that the guide block 2941 of the coupling seat 294 that is accommodated in the guide groove 2952 of the slide seat 295 may drive the slide block 299 that is mounted to the guide block 2941 of the coupling seat 294 to slide along the slide rail 2951 of the slide seat 295 that is mounted to the support bracket 291 to thereby drive the two CF-series bearings 296 that is mounted to the slide block 299 and the annular frame members 298 that are mounted to two opposite sides of the slide block 299 and received into a groove 228 that is formed in and circumferentially extends around the axle slide base 22 to clamp the axle slide base 22, whereby the axle slide base 22 can be driven to slide along the axle 81 in a more stable manner when the servomotor 292 rotates.

Figure 10:
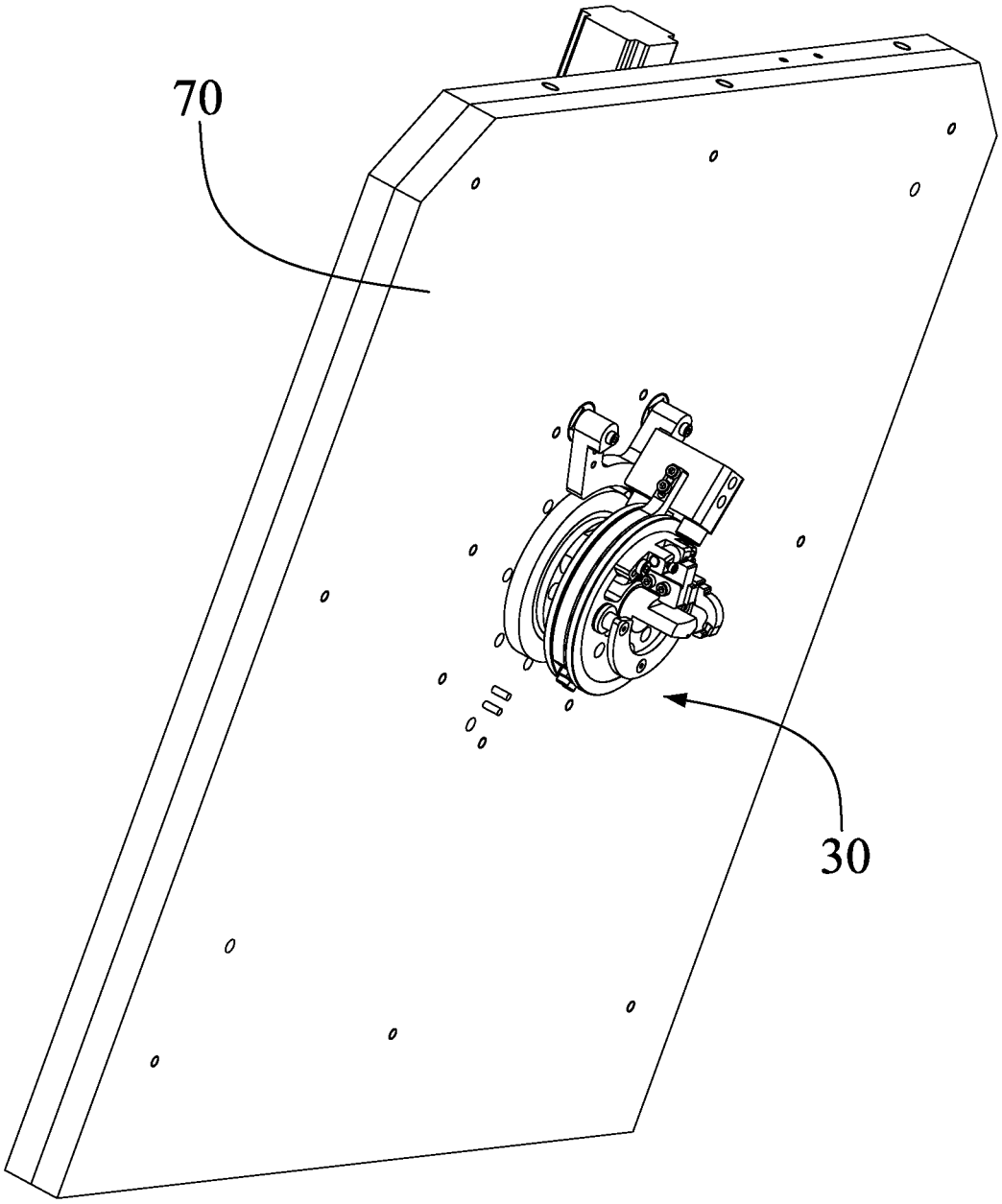
FIG. 10 is a perspective view showing a servo-rotating all-function tool module according to a third embodiment of the present invention mounted in a spring forming machine.
Figure 11:
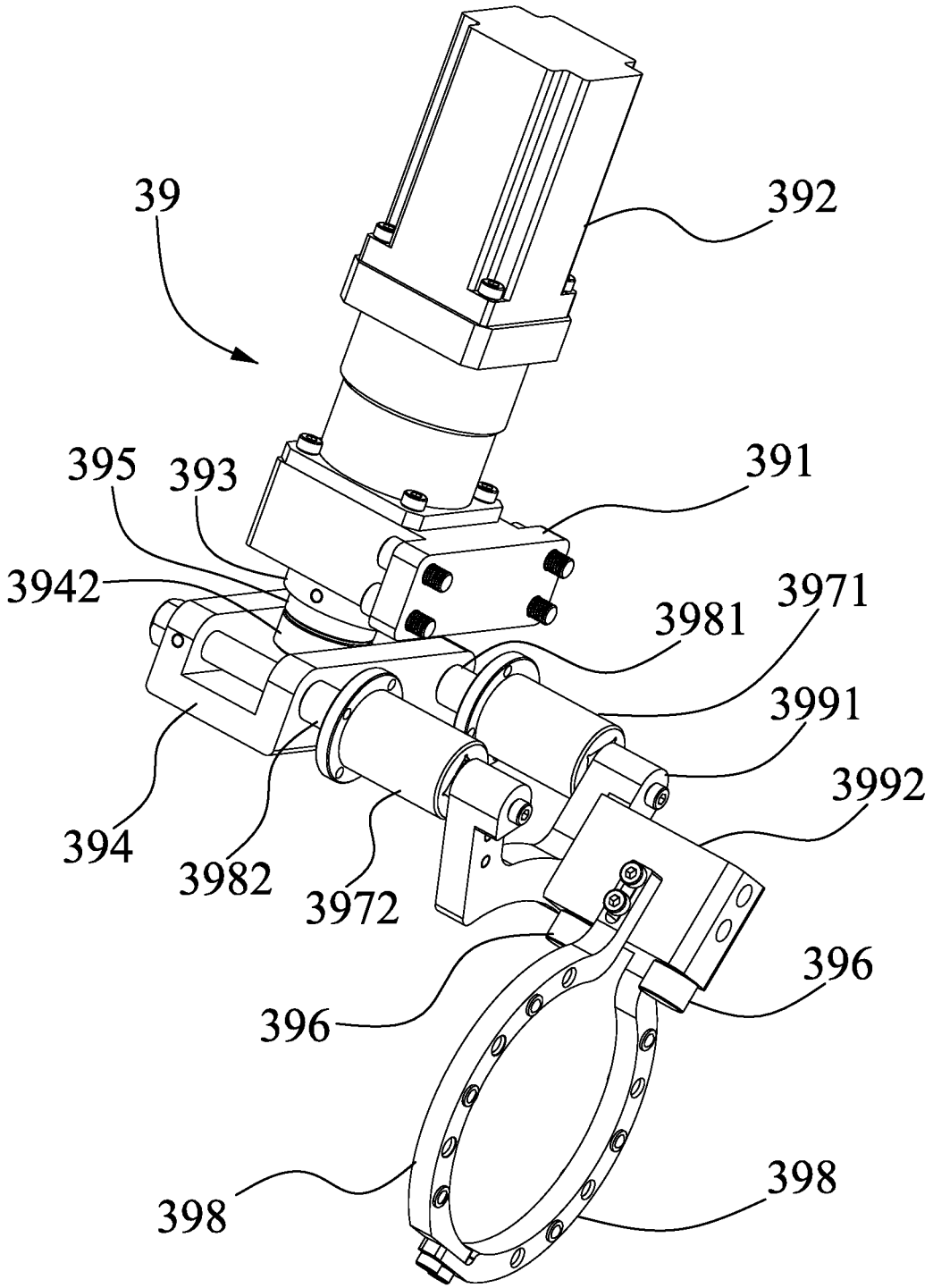
FIG. 11 is a perspective view illustrating a servo transmission module assembly of FIG. 10 in an assembled form.
Figure 12:
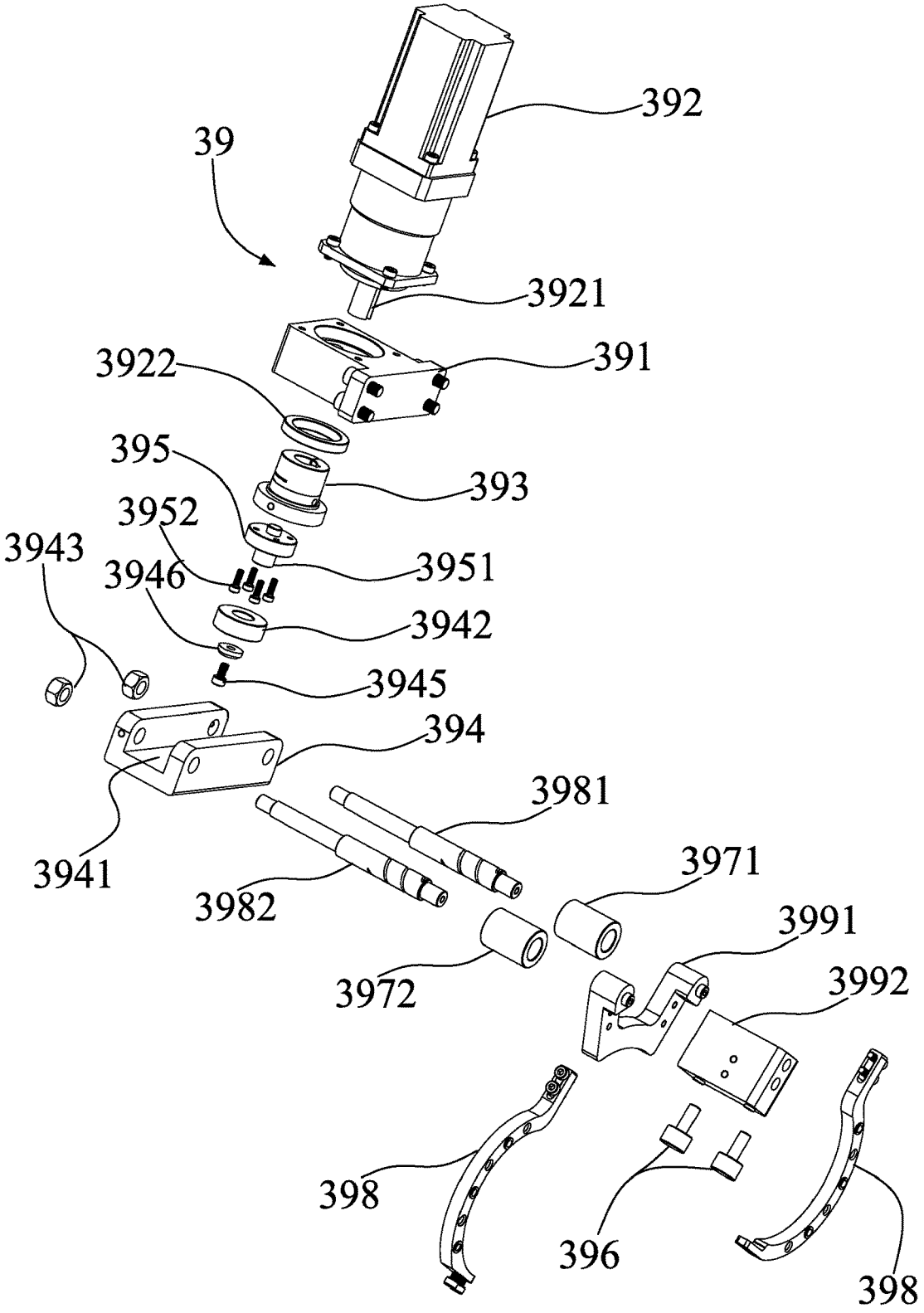
FIG. 12 is an exploded view of FIG. 11.

Referring to FIGS. 10-12, which are respectively a schematic view showing a servo-rotating all-function tool module according to a third embodiment of the present invention mounted in a spring forming machine and an assembled view and an exploded view showing a servo transmission module assembly of FIG. 10, in the drawings, the tool module 30 comprises a servo transmission module assembly 39 that has a structure different from that of the second embodiment, and an axle rotating tool module that has a structure similar to that of the second embodiment so that repeated description will be omitted.

As shown in the drawings, the servo transmission module assembly 39 comprises a support bracket 391 that is mounted to a rear side of the front wall board 70, a servomotor 392, which is mounted to the support bracket 391 and comprises a rotary shaft 3921 and of which an example may comprise a speed reducer, a rotary disc 393 that is mounted to the rotary shaft 3921 and is driven by the rotary shaft 3921 to rotate, a cam seat 394 that comprises a guide rail 3941, a bearing seat 395 that comprises a central axle 3951 extending into the guide rail 3941, a bearing 3942, two linear bearings 3971, 3972 that are mounted to the front wall board 90, two slide axles 3981, 3982 that respectively extend through the two linear bearings 3971, 3972 and have an end mounted by nuts 3943 to the cam seat 394 at two ends of the guide rail 3941, a push bar 3991 mounted to an opposite end of the two slide axles 3981, 3982, a push bar seat 3992 mounted to the push bar 3991, two annular frame members 398 that are mounted to two opposite sides of the push bar seat 3992, and two CF-series bearings 396 that are mounted to bottom sides of the push bar seat 3992.

The rotary disc 393 comprises an eccentric shaft hole (not shown), and the bearing seat 395 is mounted by screws 3952 on the eccentric shaft hole. The bearing 3942 is fixed by means of a screw 3945 and a pad 3946 to the central axle 3951 extending into the guide rail 3941 of the cam seat 394, so that the bearing 3942 arranged between the guide rail 3941 and the central axle 3951 may drive the cam seat 394, the two slide axles 3981, 3982, the push bar 3991, and the push bar seat 3992 to slide thereby driving the two CF-series bearings 396 and two annular frame members 398 that are mounted to the push bar seat 3992 to clamp the axle slide base so as to drive the axle slide base to slide along the axle when the servomotor 392 rotates. To eliminate potential swaying caused by the rotation of the servomotor 392, a bearing 3922 is arranged between the rotary shaft 3921 of the servomotor 392 and the support bracket 391.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A servo-rotating all-function tool module, which is adapted to be mounted to a spring forming machine to serve as an all-direction forming tool of the spring forming machine, wherein the spring forming machine comprises a front wall board, an axle retention seat rotatably mounted to the front wall board, and an axle mounted to the axle retention seat, the axle retention seat being extended frontward relative to a front side of the front wall board, to form two support arms, a push plate being disposed between the two support arms, comprising:

an axle slide base, which comprises a slide base hole fitted over the axle for the axle slide base to slide along the axle, and two parallel support braces arranged above the slide base hole;

an oscillating bar, which comprises a first end and a second end, and a shaft hole formed therein at a location between the first end and the second end so as to mount, in a rotatable manner, the oscillating bar between the two support arms of the axle retention seat, the first end being located under the push plate, the second end extending frontward relative to the front side of the front wall board through the slide base hole of the axle slide base;

an elastic element, which is mounted between the first end of the oscillating bar and the push plate to provide a downward push force to the oscillating bar;

a cam plate, which is mounted to the second end of the oscillating bar and comprises an ascending slope;

a bearing, which is rotatably mounted between the two support braces of the axle slide base and is positionable against the ascending slope;

a tool, which is mounted to the second end of the oscillating bar;

a servo transmission module assembly, which is mounted to the spring forming machine to provide a driving force for driving the axle slide base to slide along the axle;

wherein when the servo transmission module assembly drives the axle slide base to slide along the axle, the axle slide base causes the bearing to roll along the ascending slope to control, in combination with the elastic element, downward pressing or upward returning of the tool.

2. The servo-rotating all-function tool module according to claim 1, wherein a shaft pin that is fixed between the two support arms and is received through the shaft hole of the oscillating bar to rotatably fix the oscillating bar between the two support arms of the axle retention seat.

3. The servo-rotating all-function tool module according to claim 1, wherein a pin shaft that is fixed between the two support braces and is received through the bearing to rotatably fix the bearing between the two support braces of the axle slide base.

4. The servo-rotating all-function tool module according to claim 1, wherein the axle retention seat further comprises three parallel slide axles extending frontward therefrom and the axle slide base is provided with three bearing holes corresponding thereto with a linear bearing arranged between each of the three slide axles and the corresponding bearing holes.

5. The servo-rotating all-function tool module according to claim 4 further comprising a circular retention seat fixed to ends of the three slide axles.

6. The servo-rotating all-function tool module according to claim 1, wherein the servo transmission module assembly comprises:

a support bracket, which is mounted to the front wall board at a location below the axle and comprises a slide rail;

a servomotor, which is mounted to the support bracket and comprises a rotary shaft;

a rotary disc, which is mounted to the rotary shaft and is driven by the rotary shaft to rotate, the rotary disc comprising an eccentric shaft hole formed therein;

a link bar seat, which is mounted on the eccentric shaft hole and comprises a central axle;

a link bar, which has an end rotatably mounted to the central axle;

a slide block, which is positioned on the slide rail and is rotatably mounted to an opposite end of the link bar; and two CF-series bearing, which are mounted to the slide block and clamp the axle slide base therebetween so as to drive the axle slide base to slide along the axle when the servomotor rotates.

7. The servo-rotating all-function tool module according to claim 6, wherein the rotary shaft and the support bracket comprise a bearing arranged therebetween.

8. The servo-rotating all-function tool module according to claim 6, wherein the central axle and the link bar comprise a bearing arranged therebetween.

9. The servo-rotating all-function tool module according to claim 6, wherein the axle slide base is provided with a groove circumferentially formed therein and the slide block is provided with two annular frame members extending into the groove.

10. The servo-rotating all-function tool module according to claim 1, wherein the servo transmission module assembly comprises:

a support bracket, which is mounted to the front wall board at a location below the axle;

a servomotor, which is mounted to the support bracket and comprises a rotary shaft;

a rotary disc, which is mounted to the rotary shaft and is driven by the rotary shaft to rotate, the rotary disc comprising an eccentric shaft hole formed therein;

a first CF-series bearing, which is fixed to the eccentric shaft hole;

a coupling seat, which comprises a guide block and a guide slot, the guide slot partly accommodating the first CF-series bearing therein;

a slide seat, which is mounted to the support bracket and comprises a slide rail and a guide groove in communication with the slide rail, the guide block of the coupling seat being accommodated in the guide groove;

a slide block, which is mounted to the guide block of the coupling seat and is slidable along the slide rail; and two second CF-series bearings, which are mounted to the slide block to clamp the axle slide base therebetween so as to drive the axle slide base to slide along the axle when the servomotor rotates.

11. The servo-rotating all-function tool module according to claim 10, wherein the axle slide base is provided with a groove circumferentially formed therein and the slide block is provided with two annular frame members extending into the groove.

12. The servo-rotating all-function tool module according to claim 1, wherein the servo transmission module assembly comprises:

a support bracket, which is mounted to a rear side of the front wall board;

a servomotor, which is mounted to the support bracket and comprises a rotary shaft;

a rotary disc, which is mounted to the rotary shaft and is driven by the rotary shaft to rotate, the rotary disc comprising an eccentric shaft hole formed therein;

a cam seat, which comprises a guide rail;

a bearing seat, which is mounted on the eccentric shaft hole comprises a central axle extending into the guide rail;

a bearing, which is arranged between the guide rail and the central axle;

two linear bearings, which are mounted to the front wall board;

two slide axles, which extend through the two linear bearings respectively and have an end mounted to the cam seat at two ends of the guide rail;

a push bar, which is mounted to an opposite end of the two slide axles;

a push bar seat, which is mounted to the push bar; and two CF-series bearings, which are mounted to the push bar seat to clamp the axle slide base therebetween so as to drive the axle slide base to slide along the axle when the servomotor rotates.

13. The servo-rotating all-function tool module according to claim 12, wherein the rotary shaft and the support bracket comprises a bearing arranged therebetween.

14. The servo-rotating all-function tool module according to claim 12, wherein the axle slide base is provided with a groove circumferentially formed therein and the push bar seat is provided, on two opposite sides, with two annular frame members extending into the groove.

* * * * *